US006430861B1

(12) United States Patent
Ayers et al.

(10) Patent No.: US 6,430,861 B1
(45) Date of Patent: Aug. 13, 2002

(54) ELECTRONICALLY CONTROLLED FIREARM

(76) Inventors: Tyler Ayers, 35 Scott Ave., Watertown, CT (US) 06795; Sidney McCartney, 268 Congress Ave. #5, Waterbury, CT (US) 06708

( * ) Notice: Subject to any disclaimer, the term of this patent is extended or adjusted under 35 U.S.C. 154(b) by 0 days.

(21) Appl. No.: 09/681,727

(22) Filed: May 29, 2001

Related U.S. Application Data

(60) Provisional application No. 60/210,992, filed on Jun. 12, 2000, now abandoned.

(51) Int. Cl.[7] ..... F41A 19/58
(52) U.S. Cl. ..... 42/84; 89/28.05; 102/201
(58) Field of Search ..... 42/84; 89/28.05; 102/201

(56) References Cited

U.S. PATENT DOCUMENTS 3,618,526 A * 11/1971 Baker ..... 102/201
3,631,623 A * 1/1972 Platt ..... 42/84
3,685,392 A * 8/1972 Platt ..... 89/28.05
4,026,212 A * 5/1977 Dardick ..... 102/531
5,036,767 A * 8/1991 Folsom et al. ..... 102/201
5,212,339 A * 5/1993 Piltch ..... 102/201
5,272,828 A * 12/1993 Petrick et al. ..... 42/84
5,301,448 A * 4/1994 Petrick et al. ..... 42/70.01
5,317,973 A * 6/1994 Winaver et al. ..... 102/201
5,421,264 A * 6/1995 Petrick ..... 102/443
5,513,550 A * 5/1996 Field ..... 89/163
5,625,972 A * 5/1997 King et al. ..... 42/84
5,896,691 A * 4/1999 Kaminski et al. ..... 42/70.11
6,230,946 B1 * 5/2001 Vor Keller et al. ..... 224/244

* cited by examiner

*Primary Examiner*—Charles T. Jordan
*Assistant Examiner*—John W Zerr
(74) *Attorney, Agent, or Firm*—William C. Crutcher

(57) ABSTRACT

A firearm using a laser in place of a firing pin mechanism. Special cartridges have a lasing chip, which lases to ignite the propellant when a beam from the laser impinges on the lasing chip through a port in the breechblock. An electronic control system prevents the unauthorized use of the firearm by preventing connection of the laser power supply to the laser unless the user of the firearm is in close proximity and is authorized by an ID card.

14 Claims, 3 Drawing Sheets

ELECTRONICALLY CONTROLLED FIREARM

CROSS REFERENCE TO RELATED APPLICATIONS

This application claims the benefit of prior filed abandoned provisional application serial No. 60/210,992 filed Jun. 12, 2000.

BACKGROUND OF THE INVESTIGATION

This invention relates generally to an electronically controlled firearm and to cartridges especially adapted therefor, which employs an improved impactless ignition system for the projectile propellant. The invention also relates to an improved electronic control system for restricting the use of the firearm to authorized users.

A conventional firearm utilizes a mechanically actuated firing pin to strike a primer cap at the rear of the cartridge, to thereby ignite the propellant for the projectile. The ejection system for the spent shell may be mechanically operated or may be operated by the propellant itself. Control of the firearm is entirely within the hands of the user, whether authorized or not. This leads to possible criminal uses of the firearm, or dangerous use by children. It would be desirable to provide an improved impactless propellant ignition system for the firearm and the cartridge.

It would be desirable to provide an improved shell injection and ejection system, which simplifies firing of multiple rounds in a firearm. It would also be desirable to provide an electronic identification system, which would limit use of the firearm to authorized users.

SUMMARY OF THE INVENTION

Propellant Ignition System for Firearm and Cartridge

This weapon will function comparably to existing projectile-based weaponry, whereby a cartridge consisting of a casing which houses a slug and explosive powder is activated by a firing device of sorts. The firearm incorporates a diode laser, which is used to ignite the explosive powder within ammunition of modified design. This is achieved by modifying the ammunition to facilitate a neodymium chip ($ND:VYO_4$) at the tail of each shell initiating an internal combustion of the propellant as an internal "lasing" takes place. In order to render the weapon's laser capable of firing, a lithium-ion battery is implemented into the weapon design along with accompanying circuitry. Depression of the trigger will complete the circuit providing power to the laser, in turn, firing off a round.

Shell Injection Ejection

Due to the non-mechanical nature of the weapon's firing mechanism, an alternative method of introducing live rounds into the chamber from an ammunition clip are implemented. Spring activated components are no longer necessary in order to reactivate the firing device. The weapon will inject rounds and eject spent casings utilizing a chain-linked method. A spring-loaded ammunition clip will house a number of bullets connected by a flexible plastic chain link upon which each bullet is snapped into place. The loaded clip is then snapped into place on the underside of the weapon in its respective slot, wherein a safety mechanism on the clip is activated allowing a shell to pass through an opening in the chamber. The ammunition chain will fragment successively as each bullet is carried into the chamber and fired. The explosion within the chamber will cause such an action to occur. As each round is fired, the spent casing is directed through an opening in the side of the barrel along with the recently fragmented chain link. Alternate methods of shell injection/ejection may be utilized with said firing mechanism and/or supplemental circuitry.

Data Gathering

The electronic control system for weaponry incorporating these technologies, will hold an advantage over traditional mechanical weaponry for many reasons. Due to the electronic nature of the weapon, control possibilities increase dramatically through the utilization of digital technology. By incorporating an onboard microcomputer with accompanying circuitry and RAM, storage of user identification and firing data can be made possible. The onboard microcomputer can be made to be extremely small, as it will need to process and store minimal data. A data transfer card will supplement the onboard computer in order to retrieve data and store it on a mainframe computer (PC compatible). The data card will connect internally to the weapon via the ID card circuit connection prongs and will feed data to a PC or mainframe via a computer interface cable to be hooked up to any of the various ports (as options present). The onboard microcomputer will store data such as users logged on with accompanying dates of use and firing dates and times (military versions will allow multiple users to operate each weapon given military clearance coded ID cards). The firing data can be used to confirm or disconfirm criminal or unauthorized activity by identified users and further attempt to keep the weapon out of the hands of unauthorized users.

BRIEF DESCRIPTION OF DRAWINGS

The invention will be better understood by reference to the following description, taken in connection with the accompanying drawing, in which.

DETAILED DESCRIPTION

Figure 1:
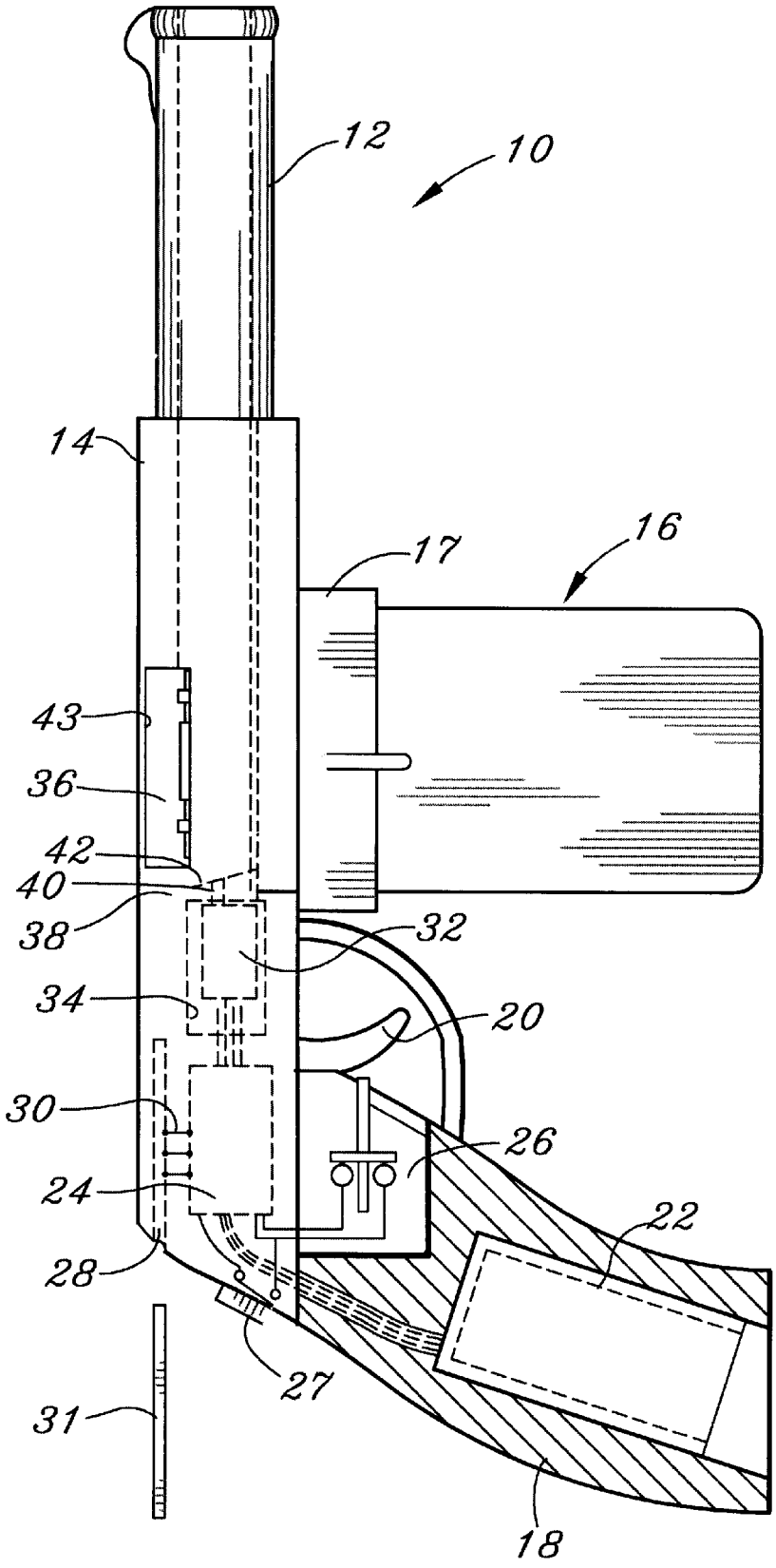
FIG. 1 is a simplified side elevation view of the improved firearm, partly in section, and schematically indicating the hidden internal components with dashed lines.

Referring now to FIG. 1 of the drawing, the firearm, shown generally at 10 comprises a barrel 12, breech housing 14, removable magazine or clip 76 with clip retaining wall 17, hand grip 18, and trigger 20. Internal components contained inside handgrip 18 include a power supply, comprising battery 22 and a spring loaded trigger switch 26 operated by trigger 20. A manual switch 27 controls mode of operation, either automatic or semi-automatic. The battery 22 and switches 26 and 27 are connected to the control module 24. A card slot 28 is arranged to include internal terminals 30, which are also connected to control module 24. Card slot 28 receives an electronic identification system card 31, having terminals (not shown) contacting terminals 30 when the card 31 is inserted into slot 28.

Control module 24 is connected to operate a 2.0 watt gallium-arsenide diode laser 32. Laser 32 is disposed in an internal chamber 34 in breech housing 74. Breech housing 14 also defines a cartridge chamber 36, which is separated from chamber 34 by a breech block 38 having a laser firing port 40. Breech block 38 also is shaped with a sloping surface on the side adjacent the cartridge chamber 38 to provide a sloping breech ejection wall 42, which is partially seen in FIGS. 2 and 3. The laser port 40 is aligned with the laser beam outlet of laser 32 and is centered and directed at the center of the rear of cartridge 44 when it is in the cartridge chamber 36. An ejection port 43 permits the ejected cartridge casing to exit from cartridge chamber 36.

Figure 2:
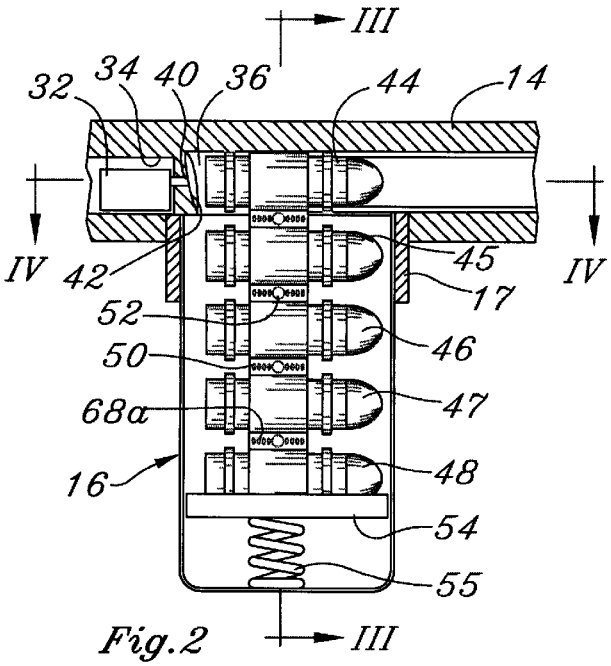
FIG. 2 is an enlarged side elevation view, in cross section, of a portion of the firearm breech housing illustrating the cartridge clip and firing ignition system in schematic form.
Figure 3:
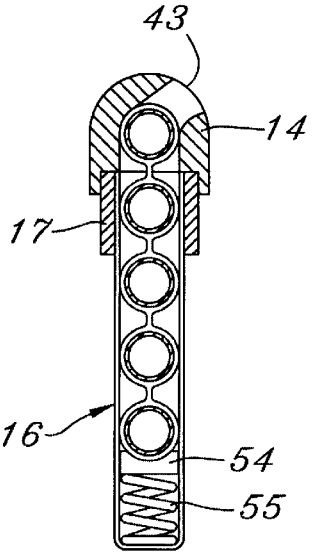
FIG. 3 is a rear elevation view of the firearm breech housing, in cross section, taken along lines III—III of FIG. 2.
Figure 4:
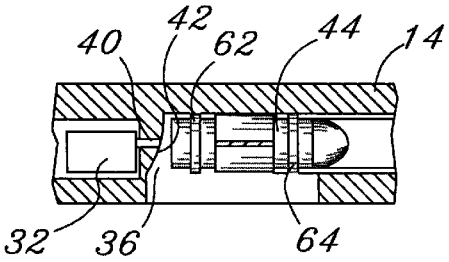
FIG. 4 is a top plan view of the breech housing in cross section, taken along lines IV—IV of FIG. 2.

Referring to FIGS. 2, 3 and 4 of the drawing, the fully loaded firearm is arranged to receive ammunition clip 16 into the breech housing 14 using the clip retaining wall 17 attached to the clip. Retaining wall 17 is received in a recess in the lower part of breech housing 14 and clamped by a conventional mechanism (not shown) to hold the clip 16 securely in place. The loaded clip 16 contains cartridges 44, 45, 46, 47 and 48 connected by a flexible plastic chain-link belt 50. The chain-link belt 50 includes an opening 52 in each web between cartridges 44–48. A conventional spring loaded platform 54, with a spring 55 biases the linked cartridges 44–48toward the cartridge chamber 36. Five cartridges are shown but the number of cartridges is purely a matter of design choice.

Figure 5:
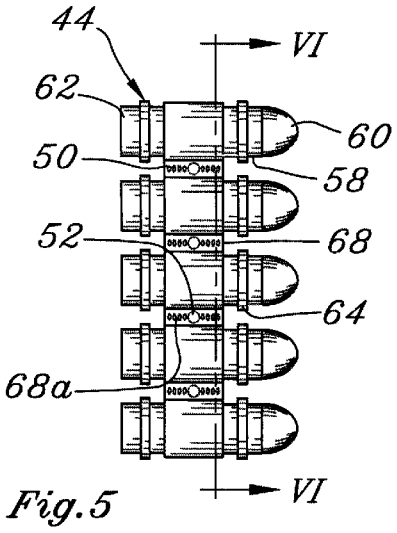
FIG. 5 is a side elevation view of a cartridge link with cartridges before insertion in the cartridge clip.
Figure 6:
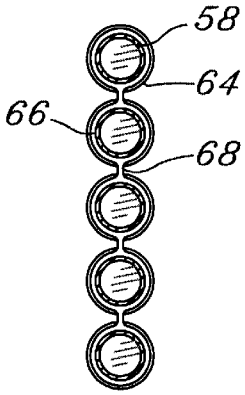
FIG. 6 is a cross section of the cartridge link and cartridges taken along lines VI—VI of FIG. 5.
Figure 7:
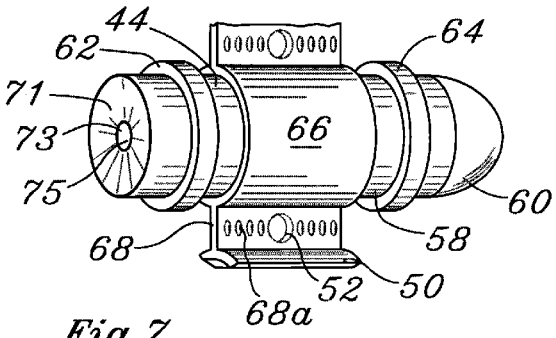
FIG. 7 is a rear perspective view of a single cartridge.

Referring now to FIGS. 5, 6 and 7, the special cartridges adapted to operate with the firearm described above will be described in greater detail. As seen in FIG. 5, each of the cartridges, such as cartridge 44, includes a cartridge casing 58 containing a propellant such as gun powder, and a projectile 60. Casing 58 is provided with raised circumferential stabilizing lands 62, 64. These may also be seen in FIG. 4, and are of the proper dimension to hold cartridge 44 stabilized and centered in chamber 36. The flexible plastic chain-link belt 50 includes circumferential walls 66 separated by webs 68. The webs are perforated with small holes 68*a* which weaken the section to tear along the web when the belt fragments during firing. The walls 66 have a smaller radius than the stabilizing casing lands 62, 64, so that the link 50 will not cause the cartridge to jam in the chamber 36.

Reference to the perspective view of FIG. 7 shows the casing 58 of cartridge 44 with stabilizing lands 62, 64 to include a rear cartridge wall 71, which is recessed and contains a central opening 73. Inserted into opening 73 is a chip of neodymium 75, which is in communication with an internal ignition primer (not shown) arranged to ignite at an elevated temperature.

Cartridge Ignition and Operation of Ejection

When the trigger switch 26 is closed by actuating trigger 20, and assuming that other switches to be discussed later are also closed, a pulsating laser beam is generated from diode laser 32 which passes through port 40 and onto the neodymium ($ND:VYO_4$) chip 75. As is known, the energy of the laser beam will cause the neodymium chip 74 to lase immediately, generating heat, which ignites the internal primer. Alternative materials include a layer of gallium arsenide or synthetic ruby for igniting the propellant. A ruby laser may be substituted for the diode laser.

The primer is in contact with the propellant, such as gun powder, which will be ignited by the primer in the conventional fashion, expelling projectile 60 down the barrel 12 and forcing cartridge casing 58 rearwardly toward the breech ejection wall 42. The cartridge casing 58 strikes the sloping breech ejection wall 42, which is angled to direct the casing from the shell ejection port 43 in breech housing 14. At the same time, the web 68 of the plastic chain-link is fragmented along the weakened section provided by holes 68*a,* allowing the cartridge casing 58 to exit, so that the next cartridge 45 may be inserted by the spring loaded clip 76 into the cartridge chamber.

Electronic Identification System

Figure 8:
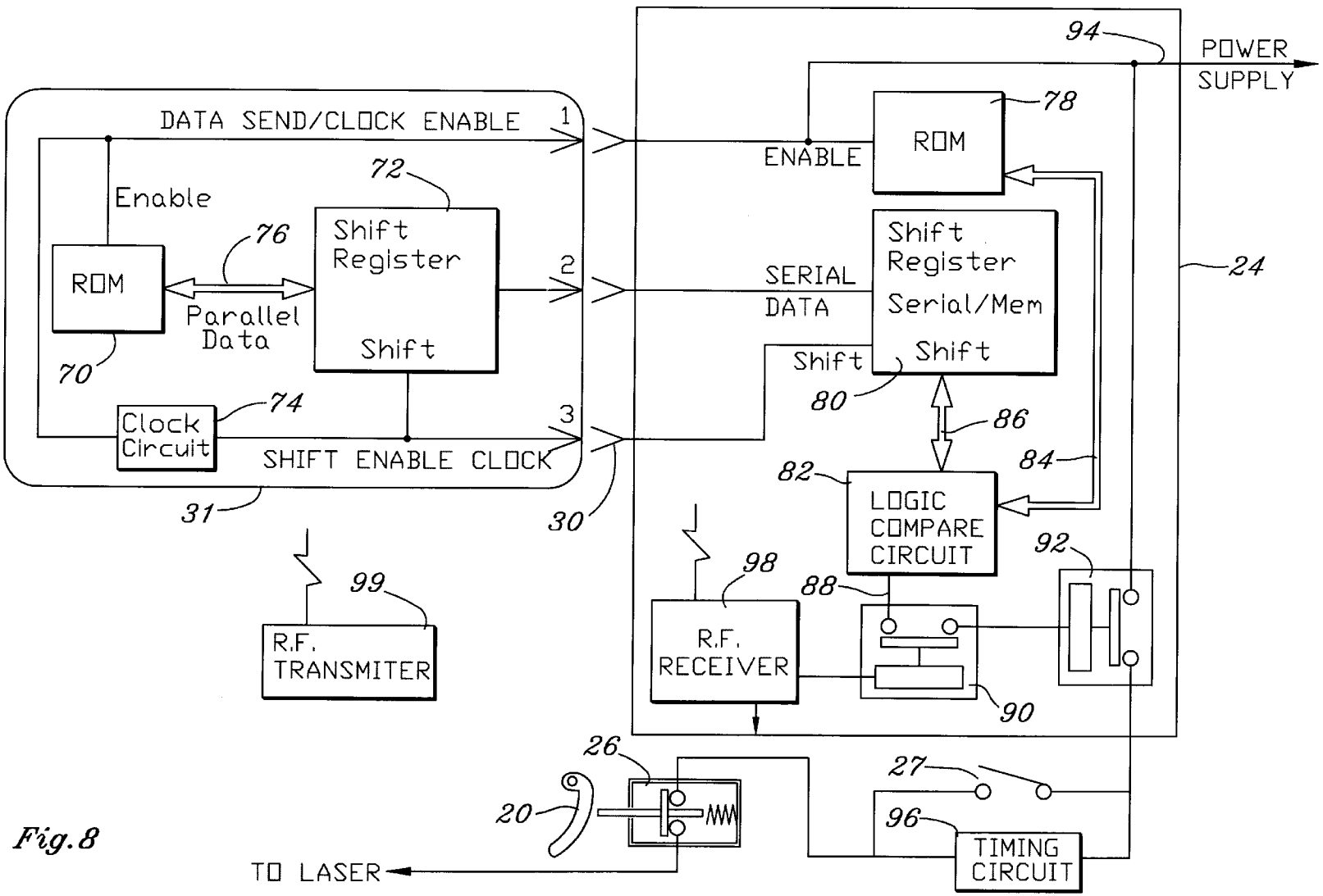
FIG. 8 is a simplified schematic block diagram of the electronic identification system.

Referring to FIG. 8 of the drawing, the simplified block diagram shows the insertable electronic identification system card 31 electrically connected to the control module 24 (enclosed within dot-dash lines) via the terminals 30, which make contact when the card 31 is inserted into slot 28 in the breech housing. Card 31 includes a ROM 70, a shift register 72 and a clock circuit 74. ROM 70 is connected to shift register 72 via a parallel data bus 76, and arranged to hold a 128-bit identification code. Control module 24, which is disposed in the breech housing, includes a similar ROM 78, shift register 80 and a logic compare circuit 82. ROM 78 also contains a 128-bit verification code which, in order for the weapon to fire, must be identical to the code stored in ROM 70. When enabled, ROM 78 transfers data to logic compare circuit 82 via bus 84. Serial data received from EIS card 31 by shift register 80 is connected to parallel data bus 86 and transferred over parallel data bus 86 to logic compare circuit 82. The two codes are compared in circuit 82 and supplied to an output lead 88. Lead 88 is connected to one terminal of a solid state switch, depicted as a relay operated switch 90. The other terminal of switch 90 is connected to a solid state switch depicted as a relay operated firing power switch 92. One terminal of switch 92 is connected to the power supply input line 94. The other terminal of switch firing power switch 92 is connected to trigger switch 26 discussed previously via a firing mode switch 27. A timing circuit 96 is connected in parallel with switch 27.

An optional safety device which may be utilized by the electronic identification system is shown as an r.f. receiver module 98, operating in conjunction with an r.f. transmitter 99. The r.f. receiver module 98 may be integrated with other circuitry on the circuit board of control module 24, receiver 98 is connected to operate switch 90 whenever a signal is received from r.f. transmitter 99. The receiver/transmitter pair 98, 99 are designed so that r.f. receiver 98 will actuate switch 90 to close the contacts of the switch whenever transmitter 99 is in close proximity, i.e., carried on the person of the operator of the firearm.

Operation of the Electronic Identification System (EIS)

The EIS is designed such that the firearm 10 cannot be fired unless:

1. The EIS card 31 is inserted into the card slot and the codes in ROMs 70 and 78 match one another,
2. The r.f. transmitter 99 carried by the operator is in close proximity to the r.f. receiver 98 in the weapon,
3. Either the manual switch 27 for semi-automatic fire is closed or the timing circuit 96 is active, and
4. Trigger switch 26 is closed by actuation of trigger 20.

When DC voltage is applied to ROM 70 by inserting the card, ROM 70 is enabled sending parallel data into shift register 72. The DC voltage also activates a clock circuit to provide timing to both shift registers 72 and 80. Serial data is then sent from the card into shift register 80, where it is converted from a serial data format into a parallel format and transmitted via bus 86 to a logic compare circuit 82. Data from ROM 78 is also fed via bus 84 to a logic compare circuit 82. The comparing circuit consists of exclusive NOR gates wired such that the output of two XNOR gates is fed into one terminal of the next XNOR gate, and the next two XNOR gate outputs are fed into the other terminal. This process continues until there is only one XNOR gate left, and if the data from the weapon shift register 80 and the ROM 78 match perfectly, the signal from the last XNOR gate activates the firing power relay 92 to enable firing power to be distributed to the weapons firing components. While there is a intermediate r.f. link relay switch 90 shown between output 88 from the logic compare circuit and firing power relay 92, to enable the r.f. link safety device, the r.f. link can be eliminated and output 88 connected directly to firing power relay 92.

If manual switch 27 is closed, the weapon is in the semi-automatic mode, and each actuation of the trigger 20 will close the contacts in switch 26 to fire the weapon.

Provision for automatic fire employs a timing circuit 96 connected in parallel with manual switch 27. Timing circuit 96 is a millisecond timer that automatically resets whenever power is applied. Thus, whenever the trigger is operated, timing circuit 96 allows power to be supplied to the laser for a predetermined millisecond time frame and then resets itself.

The main purpose of parallel connected switch 27 and timing circuit 96 is to time the firing and discharging and re-firing of the weapon in semi-automatic mode. Switch 27 is an externally located, normally open switch, which can be controlled by the operator. In the normally open position, switch 27 allows the weapon to be fired in semi-automatic mode, while in the closed position, the weapon fires in automatic mode. In the automatic mode, the laser continuously pulses under the control of its own internally pulsed power supply.

INDUSTRIAL APPLICABILITY

The provision of a laser fired impactless propellant ignition system enables simplified shell injection/ejection. Internal mechanical linkages and firing pin devices with conventional safety mechanisms are eliminated and electronic components substituted. The substitution of electronic components provides for a safe and reliable way to insure that the weapon is utilized only by authorized users. Each user will be issued a personalized EIS card upon approval for the purchase of a weapon, or the issuance thereof to law enforcement officers and/or military personnel. The weapon circuitry can only be activated when the card is inserted into the card slot in the weapon and, for a civilian weaponry, only one card will activate any one weapon. On the other hand, military and law enforcement officers may be provided ID cards to activate any weapon utilizing this technology.

While there is shown what is considered to be the preferred embodiment of the invention, other modifications will occur to those skilled in the art, and it is desired to include all such modifications as fall within the true spirit and scope of the invention.

What is claimed is:

1. The combination of:

a firearm having a cartridge chamber adapted to receive a cartridge, a laser adapted to emit a laser beam into the cartridge chamber, and a power supply connected to power the laser;

at least one cartridge arranged to be received in the cartridge chamber, said cartridge having a casing, a propellant, a primer, and including a lasing chip disposed on the rear of the cartridge adapted to lase and generate sufficient heat to cause ignition of the primer and propellant when impinged upon by said laser beam; and electronic means for selectively connecting the power supply to the laser to cause ignition of the cartridge propellant, wherein said electronic means includes a user identification card and an electronic identification system, said electronic identification system having a card receptacle and adapted to enable connection of the power supply to the laser only when the electronic identification system is enabled by inserting said user identification card into said card receptacle.

2. The combination according to claim 1, wherein said electronic means includes a manually actuated trigger switch on the firearm and a timing circuit connected in series with the trigger switch and arranged to periodically connect the power supply to the laser for providing automatic periodic firing of the firearm.

3. The combination according to claim 1, wherein said electronic means includes a portable short-range r.f. transmitter to be carried by a user and an r.f. receiver incorporated into the firearm, said r.f. receiver adapted to enable connection of the power supply to the laser only when a signal from said r.f. transmitter indicates that the user is in close proximity to the firearm.

4. The combination according to claim 1, wherein a breechblock is disposed between the laser and the cartridge in the cartridge chamber, said breechblock defining a laser firing port extending through the breechblock and aligned with the lasing chip on the rear of the cartridge for passage of the laser beam through the breechblock.

5. The combination according to claim 4, wherein said breechblock defines a sloping surface facing the rear of said cartridge, and wherein said cartridge chamber defines an ejection port sufficiently large and directed so as to allow the casing to be ejected when it strikes said sloping surface.

6. The combination of:

a firearm having a barrel, a breech housing, a laser, a hand grip and a trigger, said breech housing defining a cartridge chamber adapted to receive a cartridge, a laser chamber adapted to receive said laser, and a breechblock separating the cartridge chamber from the laser chamber, said breechblock defining a laser firing port extending through the breechblock, said laser adapted to emit a laser beam through said laser firing port into the cartridge chamber, and a power supply connected to power the laser;

at least one cartridge arranged to be received in the cartridge chamber, said cartridge having a casing, a propellant, a primer, and including a lasing chip disposed on the rear of the cartridge adapted to lase and generate sufficient heat to cause ignition of the primer and propellant when impinged upon by said laser beam; and electronic means for selectively connecting the power supply to the laser to cause ignition of the cartridge propellant, wherein said electronic means includes a user identification card and an electronic identification system disposed in the firearm, said electronic identification system having a card receptacle and adapted to enable connection of the power supply to the laser only when the electronic identification system is enabled by inserting said user identification card into said card receptacle.

7. The combination according to claim 6, wherein said electronic means includes a manually actuated trigger switch on the firearm arranged to be closed by said trigger and a timing circuit connected in series with the trigger switch and arranged to periodically connect the power supply to the laser for providing automatic continuous firing of the firearm.

8. The combination according to claim 6, wherein said electronic means includes a portable short-range r.f. transmitter to be carried by a user and an r.f. receiver incorporated into the firearm, said r.f. receiver adapted to enable connection of the power supply to the laser only when a signal from said r.f. transmitter indicates that the user is in close proximity to the firearm.

9. The combination according to claim 6, wherein the power supply is disposed in said handgrip of the firearm.

10. The combination of:

a firearm having a cartridge chamber adapted to receive a cartridge, a laser adapted to emit a laser beam into the cartridge chamber, and a power supply connected to power the laser;

at least one cartridge arranged to be received in the cartridge chamber, said cartridge having a propellant, a primer, and including a lasing chip disposed on the rear of the cartridge adapted to lase and generate sufficient heat to cause ignition of the primer and propellant when impinged upon by said laser beam, said cartridge including a cylindrical casing for containing the propellant, primer and lasing chip, a projectile disposed at the front of the casing and adapted to separate therefrom, and a plurality of spaced circumferential stabilizing lands around the casing, said lands being dimensioned to hold the cartridge centered in the cartridge chamber; and electronic means for selectively connecting the power supply to the laser to cause ignition of the cartridge propellant.

11. The combination according to claim 10, and further including a flexible cartridge belt arranged to hold a plurality of cartridges in laterally spaced relationship along the belt, said belt including circumferential walls around the cartridges and frangible webs connecting said circumferential walls.

12. The combination of:

a firearm having a barrel, a breech housing, a laser, a hand grip and a trigger, said breech housing defining a cartridge chamber adapted to receive a cartridge, a laser chamber adapted to receive said laser, and a breechblock separating the cartridge chamber from the laser chamber, said breechblock defining a laser firing port extending through the breechblock, said laser adapted to emit a laser beam through said laser firing port into the cartridge chamber, and a power supply connected to power the laser;

at least one cartridge arranged to be received in the cartridge chamber, said cartridge having a casing, a propellant, a primer, and including a lasing chip disposed on the rear of the cartridge adapted to lase and generate sufficient heat to cause ignition of the primer and propellant when impinged upon by said laser beam, said cartridge including a cylindrical casing for containing the propellant, primer and lasing chip, a projectile disposed at the front of the casing and adapted to separate therefrom, and a plurality of spaced circumferential stabilizing lands around the casing, said lands being dimensioned to hold the cartridge centered in the cartridge chamber; and electronic means for selectively connecting the power supply to the laser to cause ignition of the cartridge propellant.

13. The combination according to claim 12, wherein said breechblock defines a sloping surface facing the rear of said cartridge, and wherein said cartridge chamber defines an ejection port sufficiently large and directed so as to allow the casing to be ejected when it strikes said sloping surface.

14. The combination according to claim 12, and further including a flexible cartridge belt arranged to hold a plurality of cartridges in laterally spaced relationship along the belt, said belt including the circumferential walls around the cartridge casings and frangible webs connecting said circumferential walls.

* * * * *